US005433020A

United States Patent [19]

Leech, Jr.

[11] Patent Number: 5,433,020

[45] Date of Patent: Jul. 18, 1995

[54] APPARATUS AND METHOD FOR VACUUM DRYING

[75] Inventor: Charles S. Leech, Jr., Glendale, Ariz.

[73] Assignee: Altos Engineering, Inc., Glendale, Ariz.

[21] Appl. No.: 53,679

[22] Filed: Apr. 29, 1993

[51] Int. Cl.[6] ..... F26B 5/04

[52] U.S. Cl. ..... 34/403; 34/92; 34/408; 34/412

[58] Field of Search ..... 34/5, 15, 92, 26, 30, 34/44, 51, 46, 48, 4, 39, 402–405, 408, 412

[56] References Cited

U.S. PATENT DOCUMENTS

| | | | |
|---|---|---|---|
| 3,192,643 | 7/1965 | Rieutord | 34/54 |
| 3,259,991 | 7/1966 | Illich, Jr. | 34/5 |
| 3,262,212 | 7/1966 | De Buhr | 34/5 |
| 3,271,874 | 9/1966 | Oppenheimer | 34/5 |
| 3,352,024 | 11/1967 | Mellor | 34/5 |
| 3,382,586 | 5/1968 | Lorentzen | 34/92 |
| 3,883,958 | 5/1975 | Filipe | 34/5 |
| 4,468,866 | 9/1984 | Kendall | 34/15 |
| 4,547,977 | 10/1985 | Tenedini et al. | 34/46 |
| 4,597,188 | 7/1986 | Trappler | 34/5 |
| 4,619,054 | 10/1986 | Sato | 34/5 |
| 4,780,964 | 11/1988 | Thompson, Sr. | 34/5 |
| 4,823,478 | 4/1989 | Thompson, Sr. | 34/5 |
| 4,893,415 | 1/1990 | Moldrup | 34/92 |
| 4,924,601 | 5/1990 | Bercaw | 34/92 |
| 4,977,688 | 12/1990 | Roberson, Jr. et al. | 34/92 |
| 5,115,576 | 5/1992 | Roberson, Jr. et al. | 34/92 |

*Primary Examiner*—Denise L. Gromada
*Attorney, Agent, or Firm*—Cahill, Sutton & Thomas

[57] ABSTRACT

An article is dried in a vacuum and sublimation is prevented by controlling both the heat applied to the article and the heat lost through evaporation. The article is placed in a vacuum chamber having a plurality of infrared lamps disposed around the interior of the chamber and the chamber is heated to a predetermined temperature prior to evacuation. Heat loss is controlled by maintaining the pressure above approximately 5 torr, which controls the rate of evaporation. The drying cycle also cleans the article.

13 Claims, 4 Drawing Sheets

FIG. 4
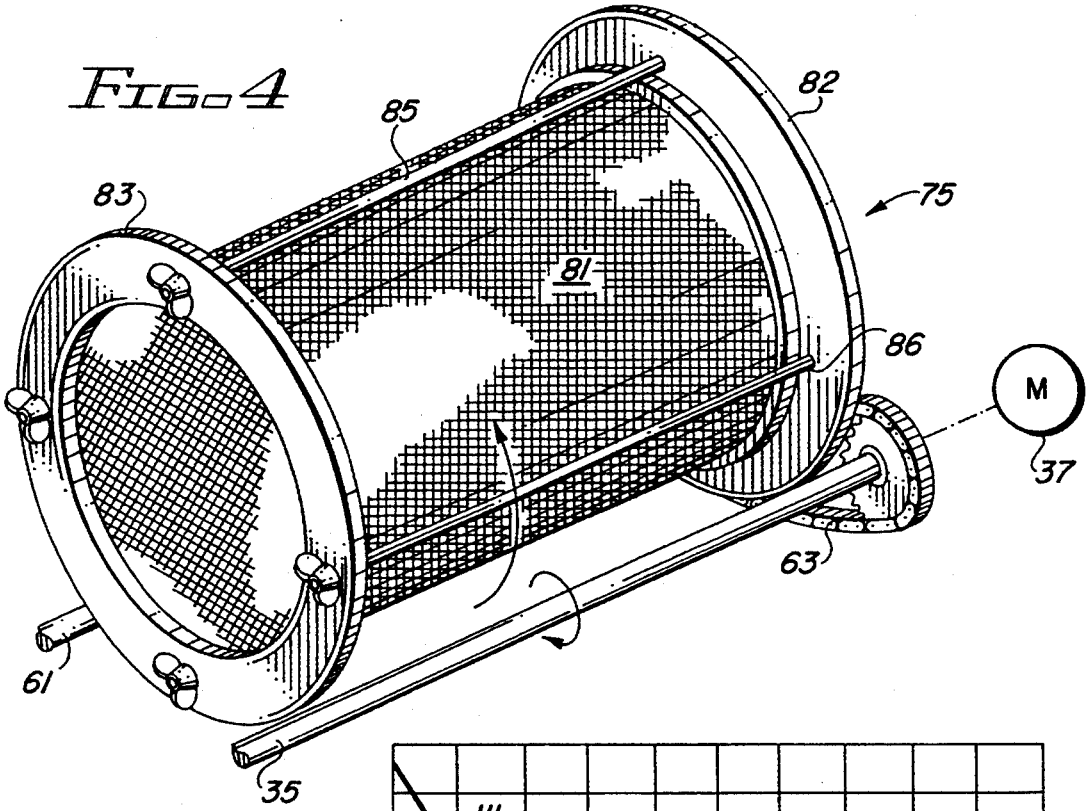
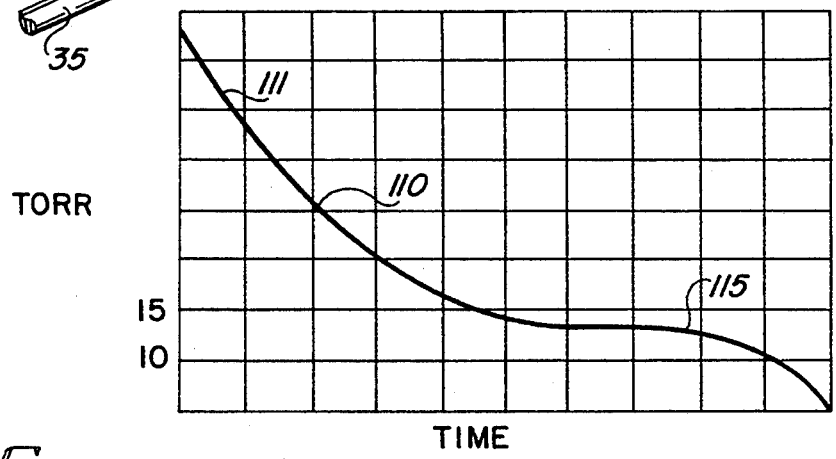
FIG. 6
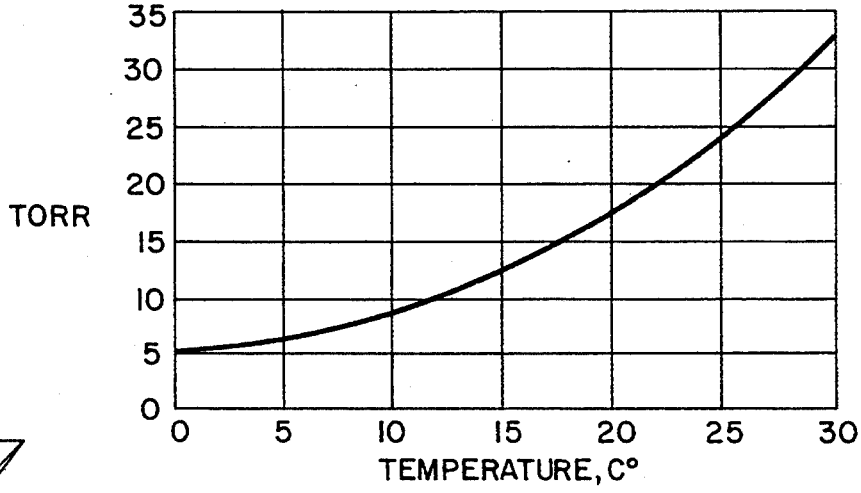
FIG. 7

APPARATUS AND METHOD FOR VACUUM DRYING

BACKGROUND OF THE INVENTION

This invention relates to vacuum drying of articles and, in particular, to apparatus and method for rapidly removing large amounts of water without sublimation.

A wide variety of products today include small components which must be completely clean of foreign material in order for the products to operate reliably. Some examples include the internal components of anti-lock braking systems, electrical connectors, metering valves for fuel injectors, and metal lids and ceramic packages for integrated circuits. The cleaning of such components typically includes several rinse operations followed by immersion in a tank containing a dense chlorofluorocarbon (CFC) compound, such as Freon 113 ($C_2ClF_3$). Since the CFC is chosen to be more dense than water, the water is displaced from the component and floats to the surface of the CFC where it is skimmed or drawn off. The component is removed from the tank and the CFC evaporates rapidly. Because of the need to eliminate CFCs from the atmosphere, many companies are seeking alternatives to drying with CFCS.

Drying articles in a partial vacuum is known in the art. Water "boils" at a lower temperature when the ambient pressure is reduced. Since the change from the liquid phase to the gas or vapor phase requires heat (540 calories per gram or $4.2\times10^3$ J/kg), the evaporating water absorbs heat from the remaining water or from the article being dried, cooling the remaining water or the article. If there is a large amount of water, i.e. more water to evaporate than can be kept above 0° C. by the heat stored in the water and in the article, then the water freezes at some point in the drying cycle and thereafter sublimes. Sublimation is a far slower process than evaporation because the vapor pressure of the water is so low, about four tort at 0° C. One could lower the pressure in the chamber even further, but the rate of sublimation does not increase significantly.

It is known in the semiconductor art to pass previously dried silicon semiconductor wafers through an evacuated oven to remove trace amounts of water from the lids and packages prior to sealing the lids to the packages. It is recognized in the prior art that evaporation from the liquid phase is more rapid than evaporation from the solid phase. For example, U.S. Pat. No. 4,468,866 —Kendall—discloses a system for drying new pipelines for natural gas by evacuating the pipeline at a controlled rate while monitoring the temperatures in and above a sample of water. An evacuation rate is chosen which prevents the formation of ice.

These techniques do not address the need for removing large amounts of water, as defined above, from articles after rinsing. For example, the lids for integrated circuit packages are typically gold plated Kovar squares, about 0.75 inches on a side. The stamping and plating operations for making the lids leave residues of contaminants which are removed by successive rinses in deionized water, perhaps including a surfactant. Within a batch of lids, many pairs of lids may be joined together by a thin layer of water. If the lids are dried using prior art techniques, the result is a mass of frozen lids surrounded by some dry lids. The mass may dry eventually but the time for processing the batch is prohibitive, e.g. 8–10 hours. Even so, the lids will be cold and water vapor in the air may condense on the surfaces of the lids as soon as the lids are removed from the dryer.

Other articles present different problems. A very difficult surface to dry is the inside of a cylinder having one closed end. Considering the ratio of length to diameter as the aspect ratio, a high aspect ratio permits the water to remain trapped in a cylinder. One example of such an article is a female electrical connector having a plurality of such cylinders in an array. The small diameter of the cylinders, e.g. 0.06 inches or less, permits water in the cylinders to be retained by surface tension. If the water were permitted to freeze, the cylinders could rupture.

In the prior art, it is known to dry articles in a hot-wall vacuum chamber. The walls are heated to prevent condensation of the water removed from the articles. This system does not prevent sublimation, as shown by an experiment in which a shallow stainless steel pan is filled with approximately one cm. of water at 20° C. The hot-wall vacuum chamber is heated to 135° C. and the pan is placed on the heated bottom of the chamber. The chamber is closed and the pressure within the chamber is reduced. Initially the water boils but, as it boils, the heat removed by vaporization cools the remaining water and the boiling slows. The water is cooled despite the heat being conducted through the pan from the bottom of the chamber. After about seven minutes, a layer of ice forms in the pan. If the pressure in the chamber is restored to atmospheric and the pan is removed at this time, the pan is hot and has a mass of ice in the middle off it. Thus, it is difficult to prevent sublimation in vacuum drying apparatus.

In view of the foregoing, it is therefore an object of the invention to dry articles in a vacuum by evaporating water only from the liquid phase.

Another object of the invention is to remove large amounts of water rapidly from articles in a vacuum drying apparatus without forming ice.

A further object of the invention is to provide a process for radiantly heating articles in a vacuum to prevent sublimation.

Another object of the invention is to provide an apparatus and method for drying articles having complex surfaces in which water can be trapped.

A further object of the invention is to provide a method and apparatus for drying articles in a vacuum without significantly changing the temperature of the articles.

Another object of the invention is to prevent ice formation in vacuum drying apparatus by controlling the rate of evaporation of the water.

A further object of the invention is to clean an article by subjecting the article to vacuum drying.

SUMMARY OF THE INVENTION

The foregoing objects are achieved in the invention in which an article is dried in a vacuum and sublimation is prevented by balancing the heat applied to the article with the heat lost through evaporation.

Apparatus embodying the invention includes a vacuum chamber having a plurality of infra-red lamps disposed around the interior of the chamber and pair of parallel rollers extending from a door of the chamber to the rear of the chamber. The articles to be dried are loaded either into a cylindrical basket or onto a tray and the basket or tray is placed on the rollers.

The door is closed and the lamps are turned on to preheat the chamber to a predetermined temperature.

When the predetermined temperature is achieved, the chamber is evacuated. Temperature is controlled by cycling the lamps between full power and partial power. Sublimation is prevented, in part, by supplying radiant energy before the chamber is evacuated, in addition to the radiant energy supplied while evaporation takes place.

In accordance with another aspect of the invention, sublimation is prevented by using a vacuum pump which does not produce a vacuum of less than 5–10 torr while water vapor is produced from liquid in the chamber. While the articles are drying, the pressure in the chamber decreases, then stabilizes, then decreases. In accordance with another aspect of the invention, the point at which the pressure stabilizes is maintained above approximately 5 torr during evaporation. Since water boils when the vapor pressure of the water exceeds the ambient pressure, the rate of evaporation, and therefore the rate of cooling, is controlled by the pressure within the chamber.

The articles are dry when the pressure decreases for the second time. A simple detector senses the pressure in the chamber and terminates the drying cycle when the pressure is less than a predetermined amount, e.g. four tort. Alternatively, the second decrease in pressure is sensed and used to indicate that the articles are dry.

In accordance with another aspect of the invention, a cooling cycle between consecutive batches ensures that the chamber is subjected to a full pre-heat before the chamber is evacuated with the next batch.

Unexpectedly, it has been discovered that drying in accordance with the invention also cleans. For example, some gold lids dried with prior art techniques inevitably have stains, indicating the presence of impurities. Rinsing gold lids and drying them in accordance with the invention has produced no stained lids in the several batches tried and even cleaned some previously stained lids.

BRIEF DESCRIPTION OF THE DRAWINGS

A more complete understanding of the invention can be obtained by considering the following detailed description in conjunction with the accompanying drawings, in which:

FIG. 4 illustrates a basket useful for holding articles for drying in the apparatus shown in FIGS. 1–3;

FIG. 6 is a chart of pressure within the chamber during a drying cycle in accordance with the invention;

FIG. 7 is a chart of the vapor pressure of pure water in the interval of 0° C.–30° C.

DETAILED DESCRIPTION OF THE INVENTION

Figure 1:
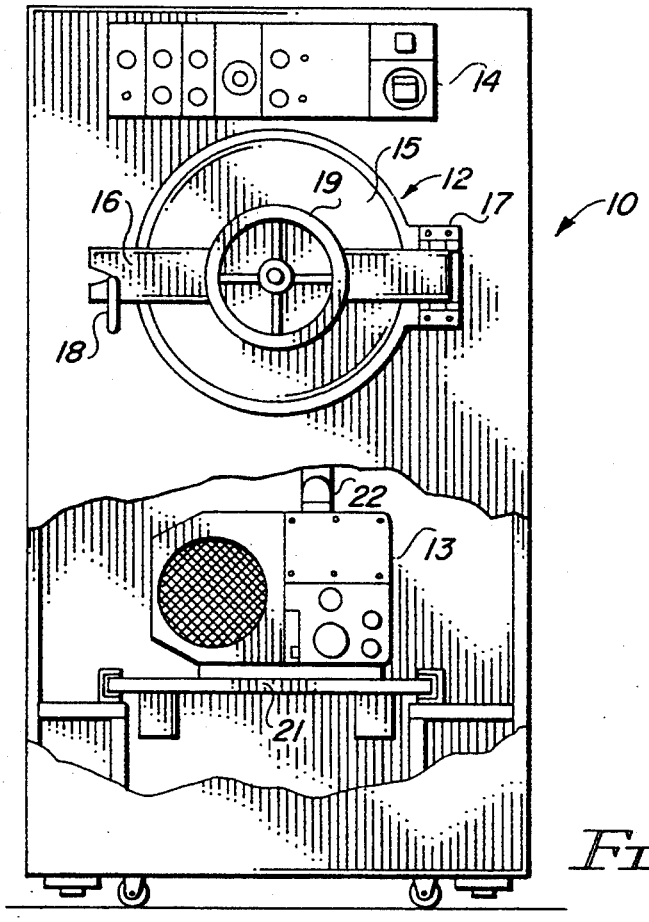
FIG. 1 is a partially cut away view of vacuum drying apparatus constructed in accordance with the invention.

FIG. 1 illustrates the major components of vacuum drying apparatus constructed in accordance with the present invention. Specifically, apparatus 10 includes vacuum chamber 12 connected to vacuum pump 13 and controlled by suitable electronics connected to front panel 14. Chamber 12 including front door 15 attached to crossbar 16 which has one end pivoted at hinge 17 and the other end held in place by a latch 18.

Vacuum pump 13 is mounted on slide out shelf 21 underneath vacuum chamber 12. The relative locations of the vacuum pump and the chamber are not critical, although the vacuum pump is preferably located near the chamber.

Figure 2:
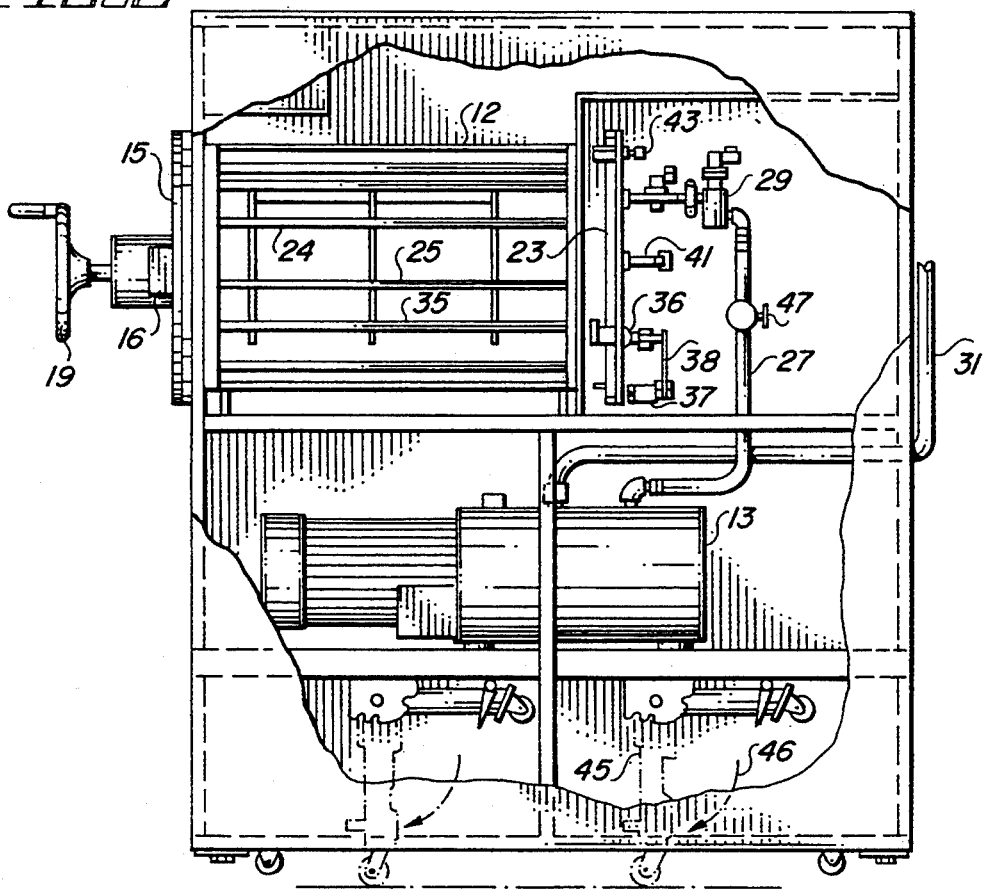
FIG. 2 is a cut away, side view of vacuum drying apparatus constructed in accordance with the invention.

FIG. 2 is a side view of apparatus 10, illustrating the construction of apparatus 10 in greater detail. Chamber 12 is an aluminum cylinder eighteen to twenty-four inches in diameter having one end of the cylinder closed by door 15 and the other end of the cylinder closed by bulkhead 23. Bulkhead 23 has a number of holes in which are mounted suitable sealed fittings for providing access to the inside of chamber 12.

The interior of chamber 12 is preferably polished and clear anodized to improve reflectivity within chamber 12, a plurality of infra-red lamps, such as lamps 24 and 25, are disposed around the inside of chamber 12 adjacent the cylindrical wall. Pump 13 evacuates chamber 12 by way of pipe 27, which is attached through trap 29 to bulkhead 23. The exhaust side of pump 13 is connected to pipe 31 which vents chamber 12 to the room in which apparatus 10 is located or to additional ventilation apparatus which sends the vapor outdoors.

Chamber 12 also includes a pair of rollers, such as roller 35, connected through fitting 36 in bulkhead 23 to an external drive mechanism including motor 37 and chain 38. Fitting 36 provides a rotating vacuum seal through bulkhead 23. Thermocouple 41 and pressure transducer 43 are connected through bulkhead 23 for sensing the temperature and pressure within chamber 12.

Pump 13 is a commercially available pump, such as a model SV-100 sold by Leybold-Heraeus, and is a substantial unit, weighing an excess of one hundred and fifty pounds. In a preferred embodiment of the invention collapsible legs such as leg 45 is attached to shelf 21 for facilitating removal of pump 13. The legs swing down in the direction shown by arrow 46 and lock into position.

There are different kinds of vacuum pumps for different levels of vacuum. Displacement (piston) pumps are typically used for reducing pressure from atmospheric (760 tort) to around 1 tort. Diffusion pumps are typically used to obtain pressures below about 10 torr and can produce pressures measured in millitorr. By using a displacement pump, the pressure in the chamber can be reduced to about 1 torr if there are no leaks in the system. Since gas (water vapor) is being produced in the chamber, it is difficult for the pump to reduce pressure much below 10–15 torr and the system is self-limiting, unless too large a pump is used. Thus, in accordance with one aspect of the invention, an open loop control system is used to prevent the formation of ice during drying.

The capacity of pump 13 is chosen relative to the internal volume of chamber 12 and the rate of evolution of water vapor such that the chamber is not evacuated below about five torr when water vapor is evaporating from the liquid phase in the chamber. For example, in one embodiment of the invention, pump 13 had a flow capacity fifty cubic feet per minute at seven tort.

There are two ways to obtain a suitable pump. One is to specify a custom pump for the manufacturer. Another is to use commercially available pumps and bleed air into the system, e.g. from valve 47 into pipe 27. This not only impedes the pump while evacuating the chamber, it also protects the pump from condensation in the pump cylinder. The amount of air bled into the system is readily determined empirically. The model SV-100 pump is known as a gas ballast pump and is intended for pumping liquid vapor. The pump includes an internal bleed to prevent liquid water from filling the pump cylinder, obviating the need for a separate bleed via valve 47.

Figure 3:
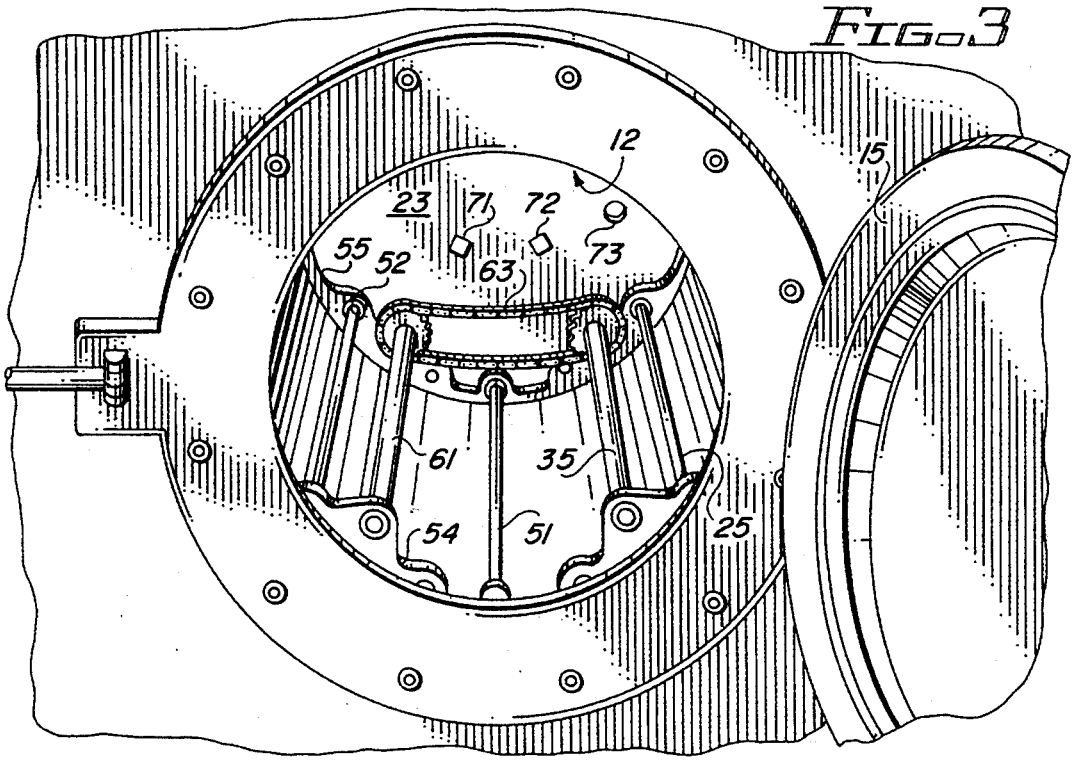
FIG. 3 is a perspective view of the chamber through the open door, showing the rotating rollers.

FIG. 3 illustrates the internal structure of chamber 12 as seen from the door of the chamber. Infra-red lamps 25, 51 and 52, and additional infra-red lamps obscured in this view of the chamber, are attached to sockets mounted in rings 54 and 55. Rings 54 and 55 are in a plane perpendicular to the longitudinal axis of the chamber and are located adjacent each end of the chamber. The rings and lamps form a heater module which is easily mounted within chamber 12. Alternatively, the infra-red lamps could be individually mounted to the interior wall of chamber 12. In one embodiment of the invention, eight lamps, each rated at 3,200 watts, are uniformly distributed around the interior of a chamber having an internal diameter of eighteen inches. The number of lamps is not critical and depends on the size of the chamber, which depends upon the size of the load.

Also within chamber 12 are rollers 35 and 61 extending parallel to each other in a horizontal plane and parallel to the longitudinal axis of chamber 12. The ends of rollers 35 and 61 are journaled into suitable bearings attached to rings 54 and 55. At the rear of chamber 12, rollers 35 and 61 are connected by sprocket and chain mechanism 63 which mechanically couples rollers 35 and 61, causing them to rotate in the same direction. Roller 35 is connected through fitting 36 to motor 37. Holes 71 and 72 in the rear of chamber 12 provide access for suitable fittings coupling electric power through bulkhead 23 to the lamps within chamber 12. Hole 73 provides access for inserting a thermocouple into chamber 12.

Rollers 35 and 61 are either left stationary or rotated, depending upon the articles to be dried. A tray is supported on rollers 35 and 61 and the rollers are kept stationary for components that can not withstand tumbling. Alteratively, as illustrated in FIG. 4, the articles to be dried are loaded into cylindrical basket 75 for rotation by the rollers. Rotating or tumbling the articles separates the articles and promotes drying.

Basket 75 includes cylindrical screen 81 mounted between end plates 82 and 83. End plates 82 and 83 are connected by rods, such as rods 85 and 86, to hold the end plates together. End plates 82 and 83 are each a metal ring having a screen attached across the inside diameter of the ring to contain the parts and provide an opening for water vapor to escape. Basket 75 is placed on rollers 35 and 61 (FIG. 4) and rotated at a suitable rate, for example 3–15 revolutions per minute.

Figure 5:
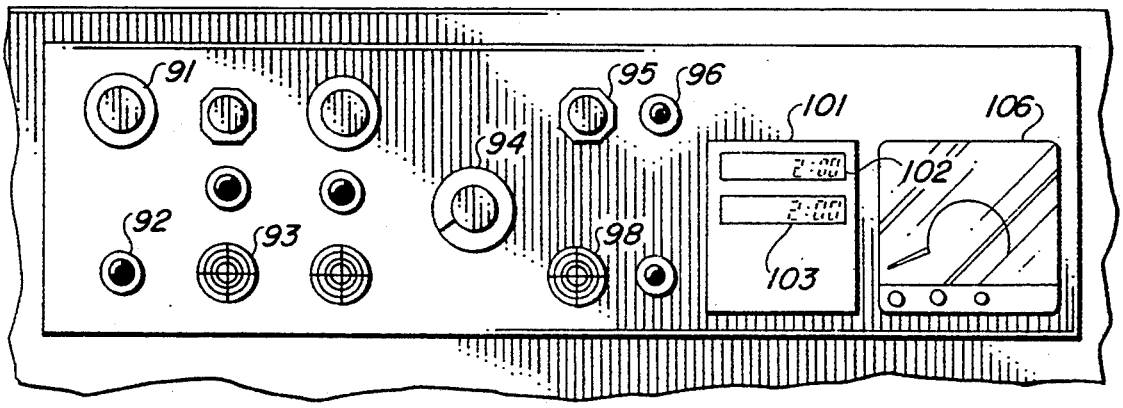
FIG. 5 illustrates a front panel of vacuum drying apparatus constructed in accordance with the invention.

FIG. 5 illustrates one embodiment of a front panel for controlling the operation of apparatus 10. Switch 91 is the main power switch and power is indicated by light 92. Dial 94 sets the rotational speed, if any, of rollers 35 and 61. Button 95 turns on the infra-red lamps within chamber 12, as indicated by light 96, and starts the drying cycle. Light 97, when turned on, indicates excessive temperature, which is also indicated by audible alarm 98. Controller 101 includes display 102 for the temperature sensed by thermocouple 41 and display 103 for indicating the preset temperature. The pressure within the chamber is indicated by vacuum gauge 106.

Figure 8:
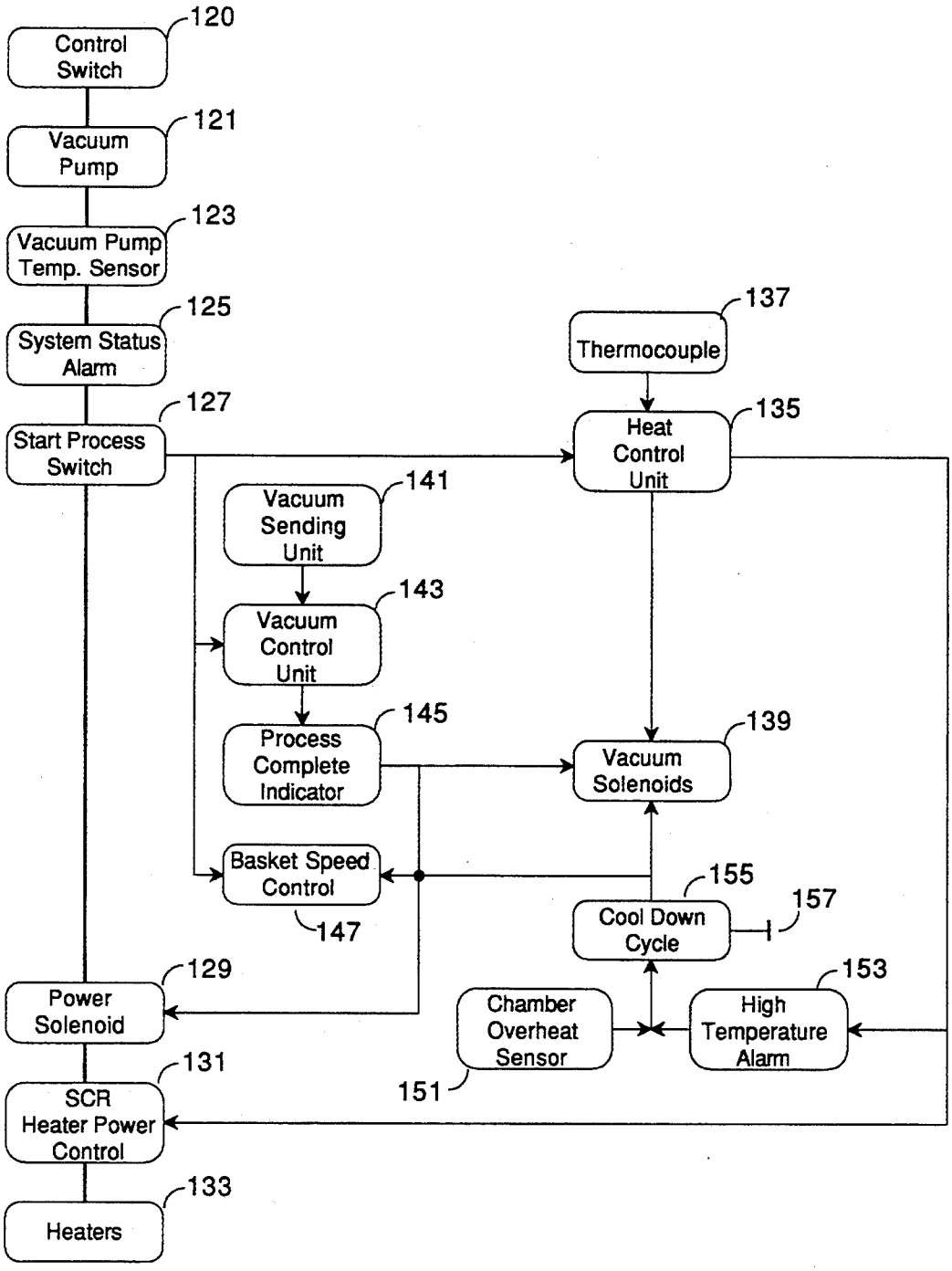
FIG. 8 is a control diagram for vacuum drying apparatus constructed in accordance with the invention.

The front panel connects to suitable circuitry for controlling power to the lamps and sensing temperature and pressure, described in conjunction with FIG. 8.

In operation, articles to be dried are loaded into a basket or onto a tray and the basket or tray is placed on rollers 35 and 61. Door 15 is closed and the infra-red lamps are turned on to preheat the chamber to the temperature set by controller 101. The infra-red lamps are initially set to full power while the chamber warms. Once the preset temperature is reached the lamps are cycled between full power and partial power. Alternatively, the lamps can be cycled on and off.

Since a thermocouple is not placed within basket 75 but merely protrudes into chamber 12, it is understood that one is really measuring the temperature of the thermocouple and assuming that this temperature is representative of the temperature within chamber 12. Thus, changing the location of the thermocouple will change the indicated temperature for preheating the chamber. A preheat to an indicated temperature of 265° C. is preferred with the thermocouple located on the bulkhead and near the lamps, as shown in FIG. 2.

When the preheat temperature is reached, valve 29 is opened and pump 13 begins evacuating chamber 12. The evacuation continues and the indicated temperature is kept below 285° C. by controlling the power supplied to the lamps. FIG. 6 illustrates the change in pressure over time within chamber 12 during evacuation. By using an open loop control system, the pressure within the chamber can be monitored as an indication of the drying process and the control system is greatly simplified. As indicated by portion 110 of curve 111, the pressure within the chamber decreases more or less uniformly until a plateau is reached, as indicated by reference number 115. When plateau 115 is reached, pump 13 is exhausting chamber 12 at a rate that is matched by the evolution of gas (water vapor) within chamber 12, plus whatever air may be bled into the system. As indicated in FIG. 6, plateau 115 is designed to occur at approximately fifteen torr.

FIG. 7 is a plot of vapor pressure verses temperature for pure water. In the range of 0°–30° C., the vapor pressure is 5–32 torr. By maintaining a pressure of 15 torr, one maintains the temperature of the articles at approximately 17° C. The heat lost by evaporative cooling is matched by the heat supplied by the infra-red lamps and the rate of cooling is controlled by maintaining the pressure above about five torr. For different types of articles the preferred pressure may be different. For example, a pressure slightly above 5 torr is preferred for articles having small crevices.

The temperature of the atmosphere in the chamber is not measured. In one embodiment of the invention, a thermometer was inserted into the open end of pipe 31 and the temperature indicated was approximately 60° C. This was merely to find out what the temperature was, it had no bearing on the process.

By balancing the evaporation rate (cooling) with the applied heat, the water evaporates from the liquid phase and does not form ice. The water evaporates rapidly and the articles are dry within approximately eight minutes. Despite the heat supplied by the lamps and despite the low pressure and rapid evaporation of water, the temperature of the articles is relatively unchanged and remains between approximately 10 and 20 degrees centigrade. Thus, temperature sensitive devices can be cleaned and dried in accordance with the invention.

After a batch is dried, the chamber is cooled before the next batch is inserted for drying. The cooling cycle permits one to use a uniform pre-heat for each batch. The chamber is preferably cooled to an indicated temperature of less than 120° C. The chamber can be cooled by any suitable means such as venting or by means of a liquid jacket around the chamber. The chamber can be cooled from the outside by ventilating the cabinet in which it is located.

The drying operation was, unexpectedly, found to contribute to the cleaning of the parts, e.g. removing trace contaminants which discolor gold plated lids. Some gold lids dried with prior art techniques inevitably have stains, indicating the presence of impurities. Rinsing gold lids and drying them in accordance with the invention has produced no stained lids in the several batches tried and even cleaned some previously stained lids.

As an example of the invention, a batch of approximately 2000 gold lids for semiconductor devices were rinsed and loaded into a cylindrical basket and the basket placed within the chamber. The chamber was preheated to an indicated temperature of 285° C. and then evacuated as described above. The lids contained approximately 900 grams of water and were completely dried in approximately seven and one half minutes, were completely separated from each other, and had no stains.

As another example of the invention, a batch of deep drawn metal cases having one closed end, a square cross-section approximately ⅛ of a inch on a side, and a length of about one inch are rinsed and dried in ten to fifteen minutes. A batch of cases typically contains 1.45 kg (3.2 pounds) of water.

FIG. 8 is a control diagram for the apparatus shown in FIGS. 1–3. In FIG. 8, the heavier lines indicate the flow of electrical power and the lighter lines indicate connections for control signals. During the drying process, control is passed from a heater control unit to a vacuum control unit. A control system constructed in accordance with FIG. 8 used solenoids. It is understood that control of the apparatus can be implemented using a microcontroller chip or a personal computer and can use open loop or closed loop control.

In FIG. 8, control switch 120 is closed, providing electrical power to vacuum pump 121. Vacuum pump is run continuously, even when no components are being dried. This assures that the pump is at a stable temperature at all times. The temperature of the pump is monitored by sensor 123. Heat sensor 123 is a temperature sensitive switch which closes when pump 121 reaches a predetermined temperature, sending electrical power to system status alarm 125 to indicate that the system is ready. Power is also sent to start process switch 127 which is controlled by the operator of the apparatus.

When a batch of articles is loaded into the chamber, the operator closes switch 127, sending power through solenoid 129, a normally closed relay switch connecting switch 127 to SCR heat control 131. Control 131 produces pulses for controlling a plurality of SCRs connected in series with the heat lamps. The heat lamps can be controlled by turning the lamps fully on and fully off or by turning the lamps partially on and off. The heat lamps are represented in FIG. 8 by block 133, labeled "heaters."

When switch 127 is closed, power is sent to heat control unit 135, which begins to heat the chamber by means of control 131. Initial control of the system is provided by heat control unit 135, which is connected to front panel controller 101 (FIG. 5). Thermocouple 137 senses the temperature within the chamber and provides a signal indicative of that temperature to control unit 135. Control unit 135 adjusts the heat applied to the chamber and raises the temperature of the chamber to the temperature set on the front panel. This is a closed loop system for regulating temperature only.

After the predetermined temperature is reached, the heat control unit sends a signal to vacuum solenoids 139, which open a valve in the vacuum line between the vacuum pump and the chamber, enabling the pump to evacuate the chamber. Vacuum sending unit 141 senses the pressure within the chamber and provides a signal indicative of that pressure to control unit 143. When the pressure in the chamber drops to 5–7 torr, vacuum control unit 143 terminates the process with a termination signal to indicator 145. Alternatively, vacuum control unit 143 monitors the pressure for plateau 115 (FIG. 6), senses a drop in pressure below the plateau as indicative of the completion of the process, and sends a termination signal to indicator 145. The termination signal is sent to vacuum solenoids 139, closing the valve to the vacuum pump and opening a valve to vent air into the chamber, restoring the chamber to atmospheric pressure. The termination signal is also sent to basket speed control 147, stopping the rotation, if any, of the basket, and to power solenoid 129, opening the solenoid and shutting off power to the heaters.

Chamber overheat sensor 151 and high temperature alarm 153 assure that the system will shut down if excessive heat is applied to the chamber. A signal from either sensor 151 or alarm 153 to cool down cycle circuit 155 causes a termination signal to be sent to vacuum solenoids 139 and to power solenoid 129, venting the chamber to atmosphere, and drawing air through the chamber by vacuum pump 121. Pressing pushbutton 157 will interrupt a drying cycle or initiate a cooling cycle between batches.

The present invention thus provides an apparatus and method for rapidly drying articles without sublimation and without significantly changing the temperature of the articles. In addition, articles rinsed and then dried in apparatus constructed in accordance with the present invention exhibit a lower defect rate than parts cleaned and dried by techniques known in the art.

Having thus described the invention it will be apparent to those of skilled in the art that various modifications can be made within the scope of the invention. For example, the apparatus can be scaled for different applications, depending upon the size of the articles to be dried. The apparatus of the invention can be incorporated into a system for washing and rinsing parts, thereby obviating the transfer of articles from one apparatus to another. In applications where the chamber can become pressurized rather than evacuated, door 15 must be held shut. In FIG. 1, hand wheel 19 turns a threaded shaft, not shown, against door 15 to press door 15 against the opening of chamber 12. Instead of bleeding air into the system to control pressure (and the rate of evaporation), one can cycle or throttle the vacuum pump, e.g. by a shut-off valve in pipe 27. Although the chamber is described in a preferred embodiment as having a horizontal longitudinal axis, it is understood that the axis of the chamber can be oriented in any direction. It is preferable to tilt the chamber slightly from horizontal to cause water to flow to the front or the rear of the chamber. Prior to evacuating the chamber, a drain in the bottom of the chamber releases any accumulated liquid which drips from the articles. Draining accumulated water increases the speed of the drying cycle since less water must be removed from the chamber by evaporation. The chamber can be flushed or vented with any gas or gas mixture rather than air. This would be done, for example, for articles particularly sensitive to oxidation. Other sources of heat can be used instead of heat lamps. For example, "Calrod" heaters or a conductive heater (hot plate) can be used. A hot plate is used for certain applications in which the articles are sensitive to radiant heat. Instead of polishing the interior surface of the chamber, reflectivity can be increased by other techniques, such as a thin gold coating. An infra-red sensor or a thermistor can be used instead of the thermocouple. The rollers can be interconnected outside the chamber rather than inside. Although described in terms of drying articles, it is understood that the invention can be used for removing adsorbed water from other materials, e.g. powders.

I claim:

1. A process for removing a large amount of liquid water from an article under vacuum without sublimation, said process comprising the steps of:

placing said article in a vacuum chamber;

maintaining the temperature of said article above 0° C. by evacuating said chamber while heating said article to cause said water to evaporate from said article; and controlling the rate of evaporation of said water by maintaining the pressure within said chamber above a predetermined, reduced pressure while said water converts from the liquid phase to the vapor phase.

2. The process as set forth in claim 1 wherein said controlling step includes:

applying sufficient heat to said article to replenish the heat of vaporization lost through evaporation and to maintain said predetermined, reduced pressure above 14 torr.

3. The process as set forth in claim 1 wherein said controlling step includes:

applying sufficient heat to said article to replenish the heat of vaporization lost through evaporation and to maintain said predetermined, reduced pressure above 5 torr.

4. The process as set forth in claim 1 and further comprising the step of:

pre-heating said chamber for a predetermined time prior to reducing the pressure within said chamber.

5. The process as set forth in claim 4 wherein said pre-heating step and said heating step include radiantly heating said chamber.

6. The process as set forth in claim 5 wherein said pre-heating step includes the step of supplying constant power to an infra-red lamp in said chamber and said heating step includes the step of supplying varying power to said infra-red lamp.

7. The process as set forth in claim 1 and further comprising the step of:

monitoring the pressure within said chamber; and terminating said process when the pressure drops below said predetermined, reduced pressure.

8. The process as set forth in claim 1 and further comprising the step of:

monitoring the pressure within said chamber; and terminating said process when the pressure drops below 5 torr.

9. Apparatus for removing a large amount of liquid water from articles under vacuum without freezing said water, said apparatus comprising:

an evacuable chamber for containing said articles;

a plurality of heaters within said chamber;

a vacuum pump connected to said chamber for reducing the pressure within said chamber to a predetermined pressure while water vapor is evolving from said articles;

a control system for maintaining the temperature of said article above 0° C.; and a valve connecting said pump to said chamber, said valve supplying a predetermined amount of air to said pump for preventing said pump from reducing the pressure in said chamber below approximately 5 torr while water vapor is evolving from said articles.

10. Apparatus for removing a large amount of liquid water from articles under vacuum without freezing said water, said apparatus comprising:

an evacuable chamber for containing said articles;

a plurality of heaters within said chamber;

a vacuum pump connected to said chamber for reducing the pressure within said chamber to a predetermined pressure while water vapor is evolving from said articles; and a control system for maintaining the temperature of said article above 0° C.; wherein said control system includes a pressure sensor for producing an electrical signal indicative of the pressure within said chamber;

a temperature sensor for producing an electrical signal indicative of the temperature within said chamber;

a vacuum pump connected to said chamber for evacuating said chamber;

a solenoid valve connected between said vacuum pump and said chamber;

a heat control circuit connected to said heaters and to said temperature sensor for heating said chamber and maintaining said chamber at a predetermined temperature; and a vacuum control circuit connected to said pressure sensor and to said solenoid valve for terminating the evacuation of said chamber when the pressure in said chamber falls below 5 torr.

11. The apparatus as set forth in claim 10 wherein said heat control circuit and said vacuum control circuit are electrically connected; and said heat control circuit enables said vacuum control circuit in response to a signal from said temperature sensor indicating that said chamber is at said predetermined temperature.

12. A process for removing a large amount of liquid water from an article by evaporation without sublimation, said process comprising the steps of:

placing said article in a vacuum chamber;

pumping said chamber to reduce the pressure within said chamber;

supplying heat of vaporization to said article to produce water vapor and to increase the pressure within said chamber;

continuing pumping and supplying heat until the pressure within said chamber drops below 5 torr; and terminating pumping and supplying heat when said pressure drops below 5 torr;

whereby the temperature of said article remains above 0° C. during the entire time said water is being evaporated.

13. The process as set forth in claim 12 wherein said supplying step includes the step of pre-heating said chamber prior to reducing the pressure within said chamber.

* * * * *